US006688935B1

(12) United States Patent
Lin

(10) Patent No.: US 6,688,935 B1
(45) Date of Patent: Feb. 10, 2004

(54) BUBBLE-BLOWING APPARATUS

(76) Inventor: Mo-Hsin Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 10/337,784

(22) Filed: Jan. 8, 2003

(65) Prior Publication Data

(65)

(51) Int. Cl.[7] ..... A63H 33/28

(52) U.S. Cl. ..... 446/15; 446/16; 446/17; 206/216; 215/6; 273/153 R

(58) Field of Search ..... 446/15–21, 71–74, 446/76, 267, 491; 206/216, 315.1, 217; 273/153 R, 109; 215/6, 386

(56) References Cited

U.S. PATENT DOCUMENTS 180,132 A * 7/1876 Hoard et al. ..... 215/6
3,732,999 A * 5/1973 Rounkles ..... 215/6
4,932,542 A * 6/1990 Chen et al. ..... 215/383
5,029,700 A * 7/1991 Chen ..... 206/217
5,967,307 A * 10/1999 Wang ..... 206/217
6,098,794 A * 8/2000 Lin ..... 206/217
2001/0035413 A1 * 11/2001 Thai ..... 220/213

* cited by examiner

*Primary Examiner*—Jacob K. Ackun

*Assistant Examiner*—Bena B. Miller

(74) *Attorney, Agent, or Firm*—Troxell Law Office PLLC

(57) ABSTRACT

A bubble-blowing apparatus is constructed to include a fluid container holding a bubble fluid, an applicator for picking up the bubble fluid for blowing bubbles, and an attachment detachably mounted on the front side of the fluid container, the attachment having a toy, for example, a maze, picture puzzle, etc., provided at the front side thereof.

6 Claims, 14 Drawing Sheets

BUBBLE-BLOWING APPARATUS

BACKGROUND OF THE INVENTION

1. Field of the Invention

The present invention relates a bubble-blowing apparatus and, more particularly to such a bubble-blowing apparatus, which has an attachment detachably secured thereto and carrying a game toy.

2. Description of the Related Art

A conventional bubble-blowing apparatus generally comprises a fluid container holding a bubble fluid, and an applicator for picking up the bubble fluid from the fluid container for blowing bubbles. The fluid container has an opening through which the applicator is inserted into the fluid container to pick up the bubble fluid. This design of bubble-blowing apparatus becomes useless when the bubble fluid used up.

SUMMARY OF THE INVENTION

The present invention has been accomplished under the circumstances in view. It is the main object of the present invention to provide a bubble-blowing apparatus, which can be used as a toy when the bubble fluid used up. According to one aspect of the present invention, the bubble-blowing apparatus comprises a fluid container holding a bubble fluid, an applicator for picking up the bubble fluid for blowing bubbles, and an attachment detachably mounted on the front side of the fluid container and having a toy provided at the front side. According to another aspect of the present invention, the toy can be a maze, a picture puzzle, a drawing board, or any of a variety of intelligent toys.

DETAILED DESCRIPTION OF THE PREFERRED EMBODIMENT

Figure 1:
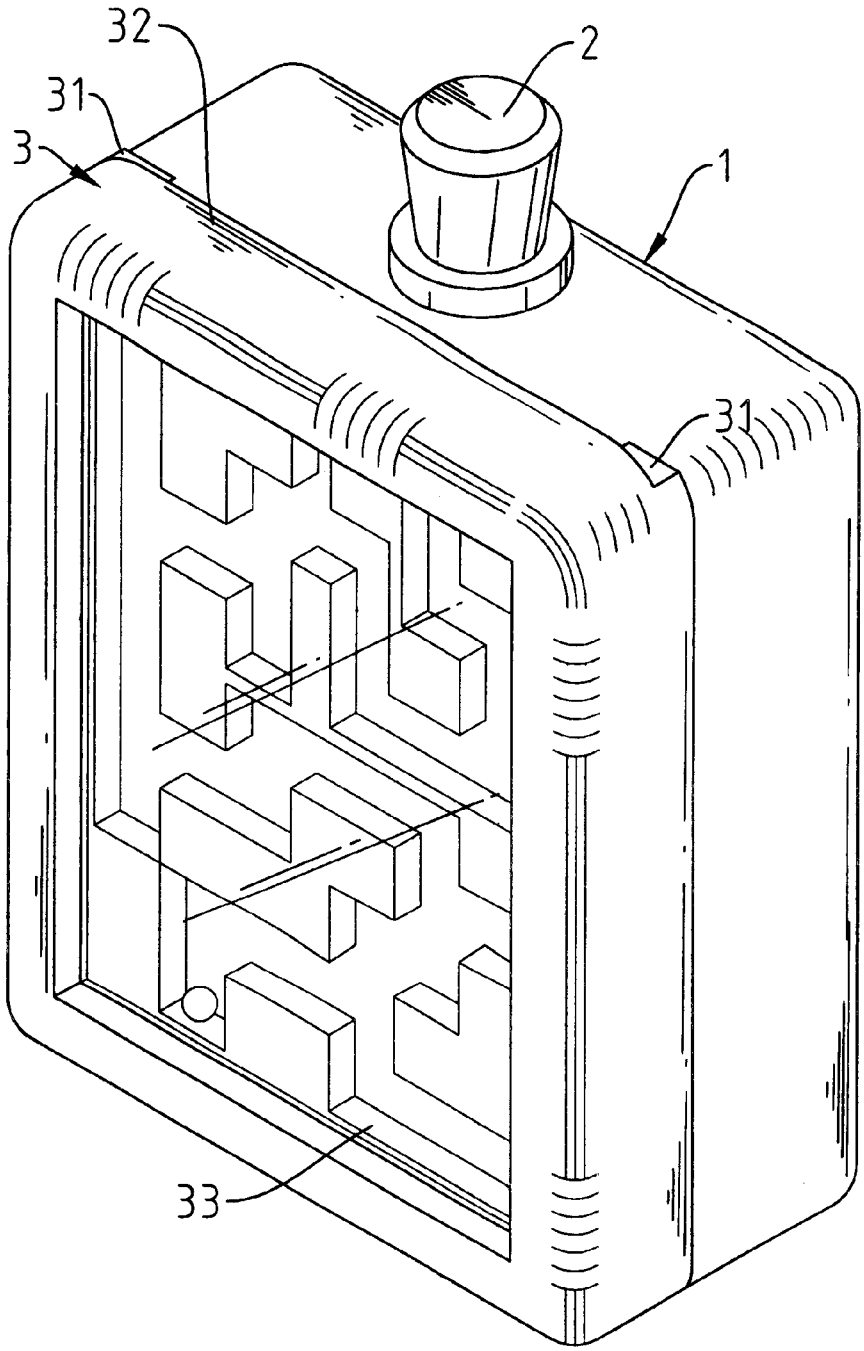
FIG. 1 is an elevational view of a bubble-blowing apparatus according to the first embodiment of the present invention.
Figure 2:
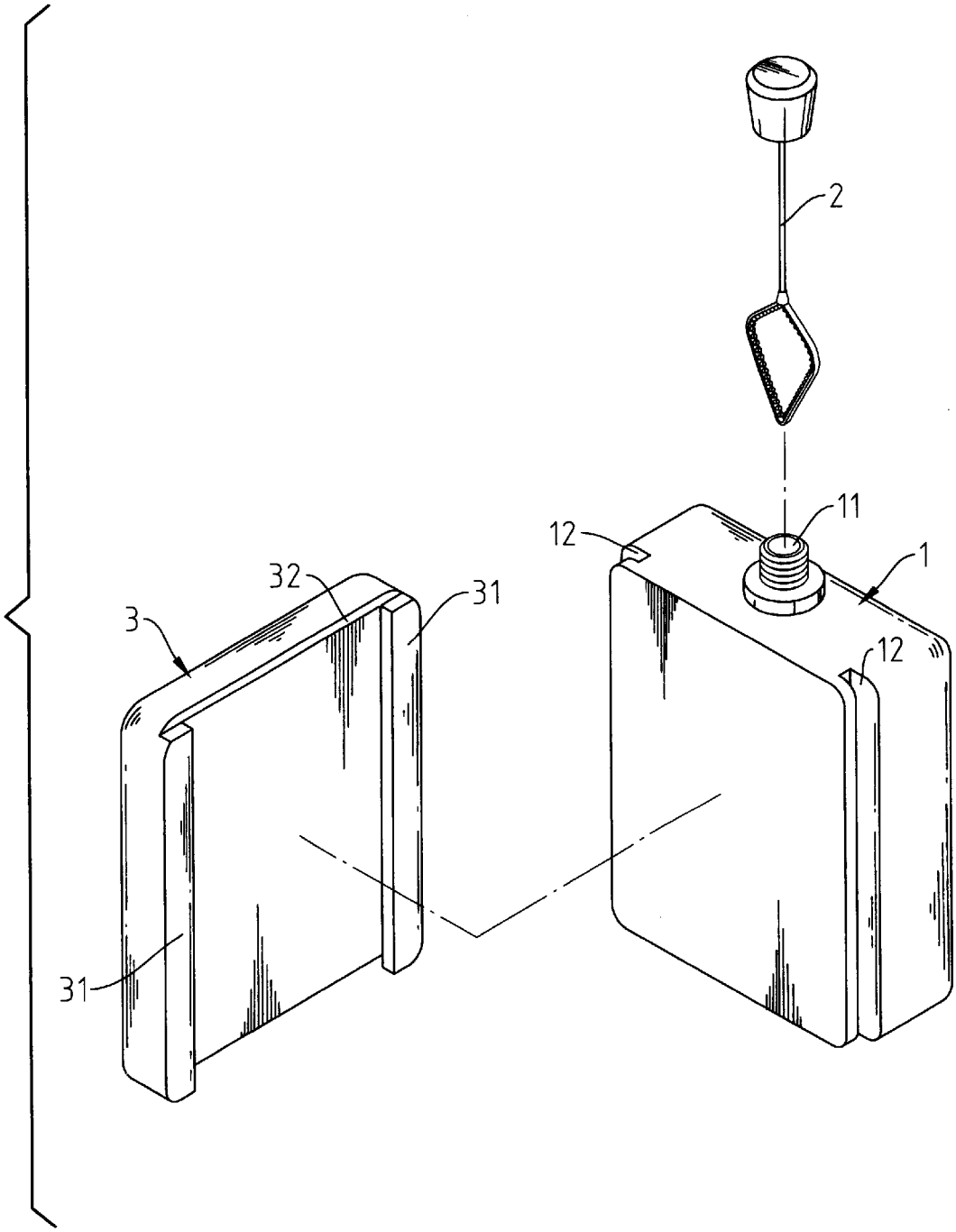
FIG. 2 is an exploded view of the bubble-blowing apparatus according to the first embodiment of the present invention.
Figure 3:
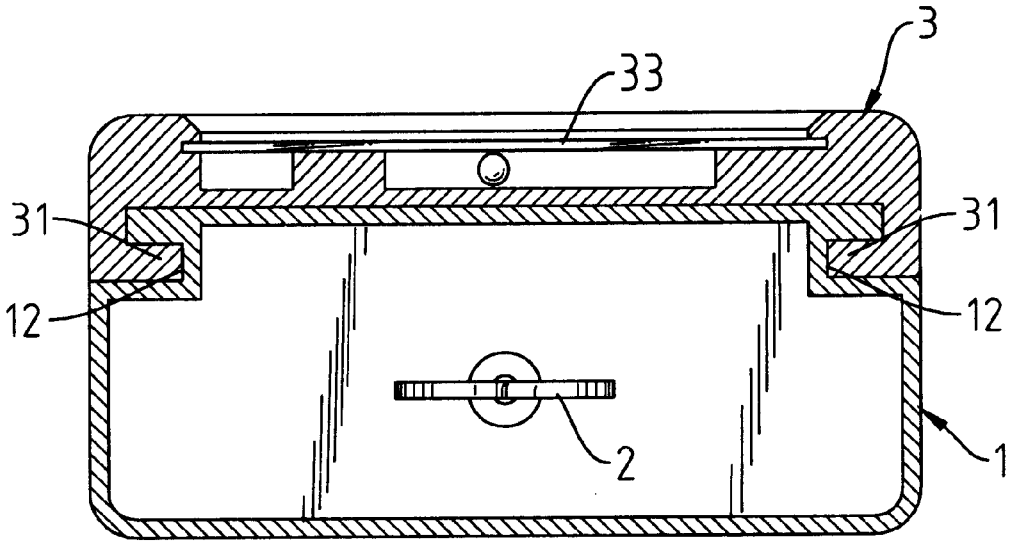
FIG. 3 is a cross-sectional view of the bubble-blowing apparatus according to the first embodiment of the present invention.

Referring to FIGS. 1~3, a bubble-blowing apparatus in accordance with the first embodiment of the present invention is shown comprised of a fluid container 1, an applicator 2, and an attachment 3. The fluid container 1 holds a bubble fluid for blowing bubbles, having a bobble neck 11 and two coupling grooves 12 longitudinally extended along two opposite lateral sidewalls. The applicator 2 can be inserted into the fluid container 1 to pick up the bubble fluid for blowing big bubbles, and can be fastened to the bottleneck 11 to close the fluid container 1. The attachment 3 has a toy 33 incorporated in the front side, a stop flange 32 transversely disposed at the top, and two coupling rails 31 longitudinally arranged in parallel at the back wall below the top flange 32 corresponding to the coupling grooves 12 of the fluid container 1. The attachment 3 is fastened to the fluid container 1 by inserting the coupling rails 31 into the coupling grooves 12, keeping the stop flange 32 stopped at the top wall of the fluid container 1. The toy 33 can be a maze, puzzle, painting board, etc.

Figure 4:
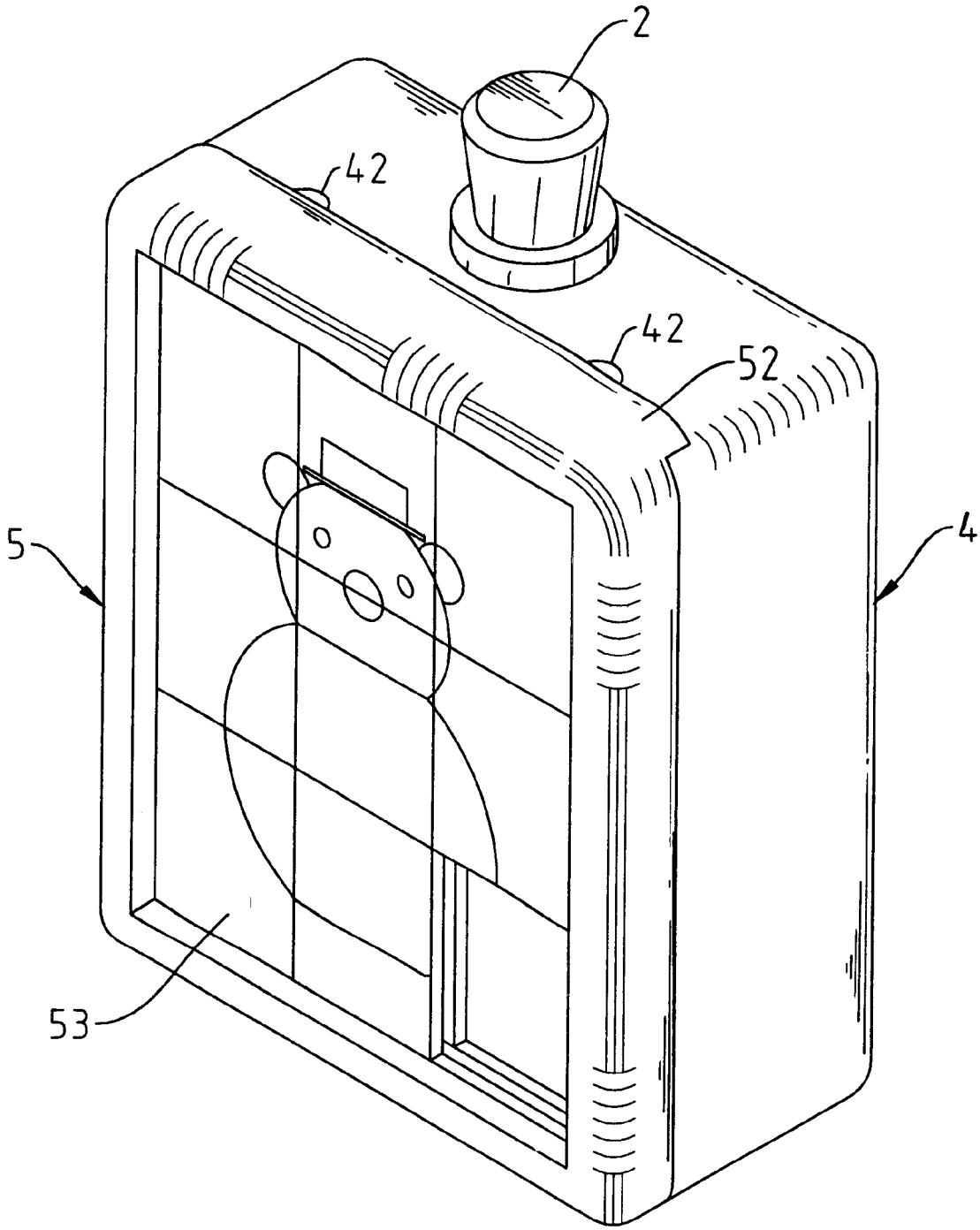
FIG. 4 is an elevational view of a bubble-blowing apparatus according to the second embodiment of the present invention.
Figure 5:
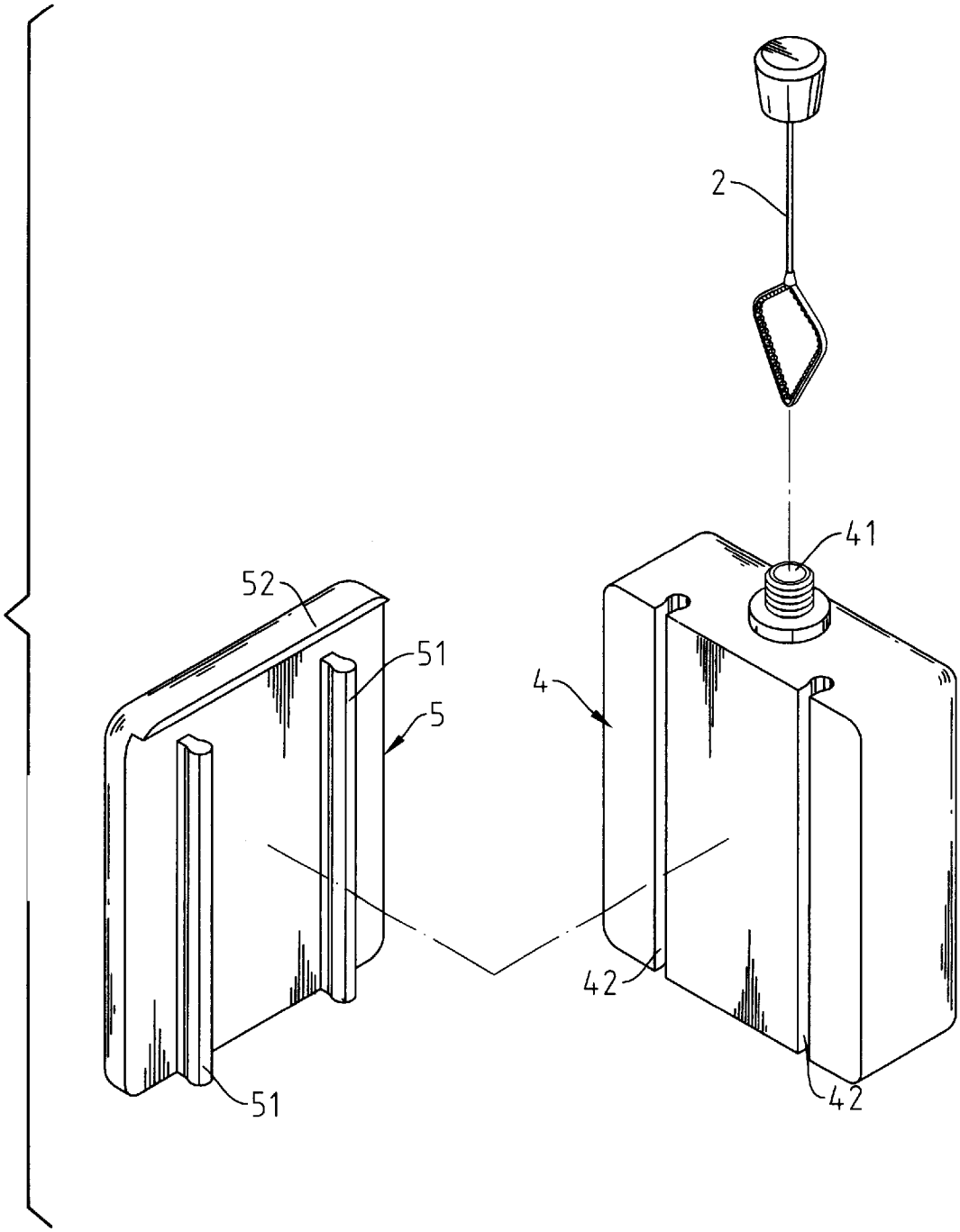
FIG. 5 is an exploded view of the bubble-blowing apparatus according to the second embodiment of the present invention.
Figure 6:
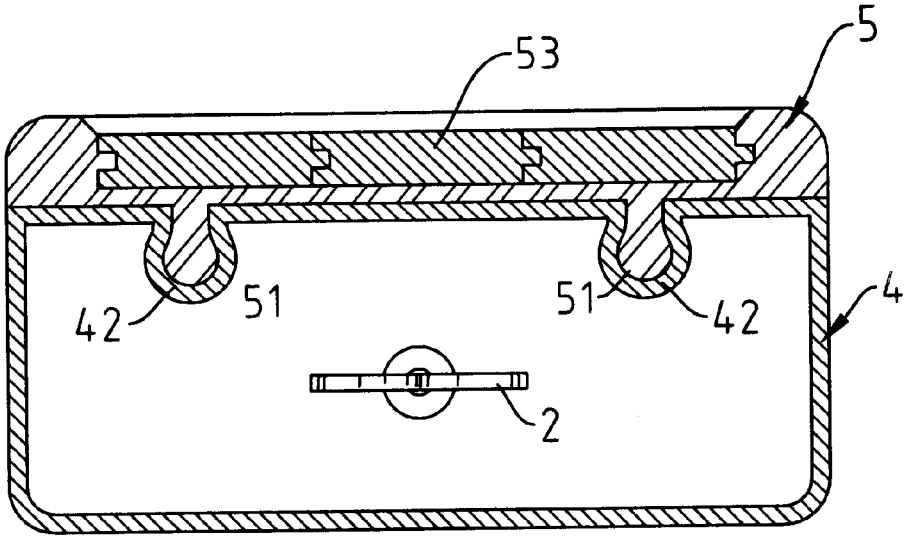
FIG. 6 is a cross-sectional view of the bubble-blowing apparatus according to the first embodiment of the present invention.

FIGS. 4~6 show a bubble-blowing apparatus according to the second embodiment of the present invention. According to this embodiment, the bubble-blowing apparatus is comprised of a fluid container 4, an applicator 2, and an attachment 5. The fluid container 4 holds a bubble fluid for blowing bubbles, having a bobble neck 41 and two coupling grooves 42 longitudinally arranged in parallel in the front sidewall and extended to the top and bottom walls. The attachment 5 has a toy 53 incorporated in the front wall, a stop flange 52 transversely disposed at the top, and two coupling rails 51 longitudinally arranged in parallel at the back wall below the top flange 52 corresponding to the coupling grooves 42 of the fluid container 4. The attachment 5 is fastened to the fluid container 4 by inserting the coupling rails 51 into the coupling grooves 42, keeping the stop flange 52 stopped at the top wall of the fluid container 1.

Figure 7:
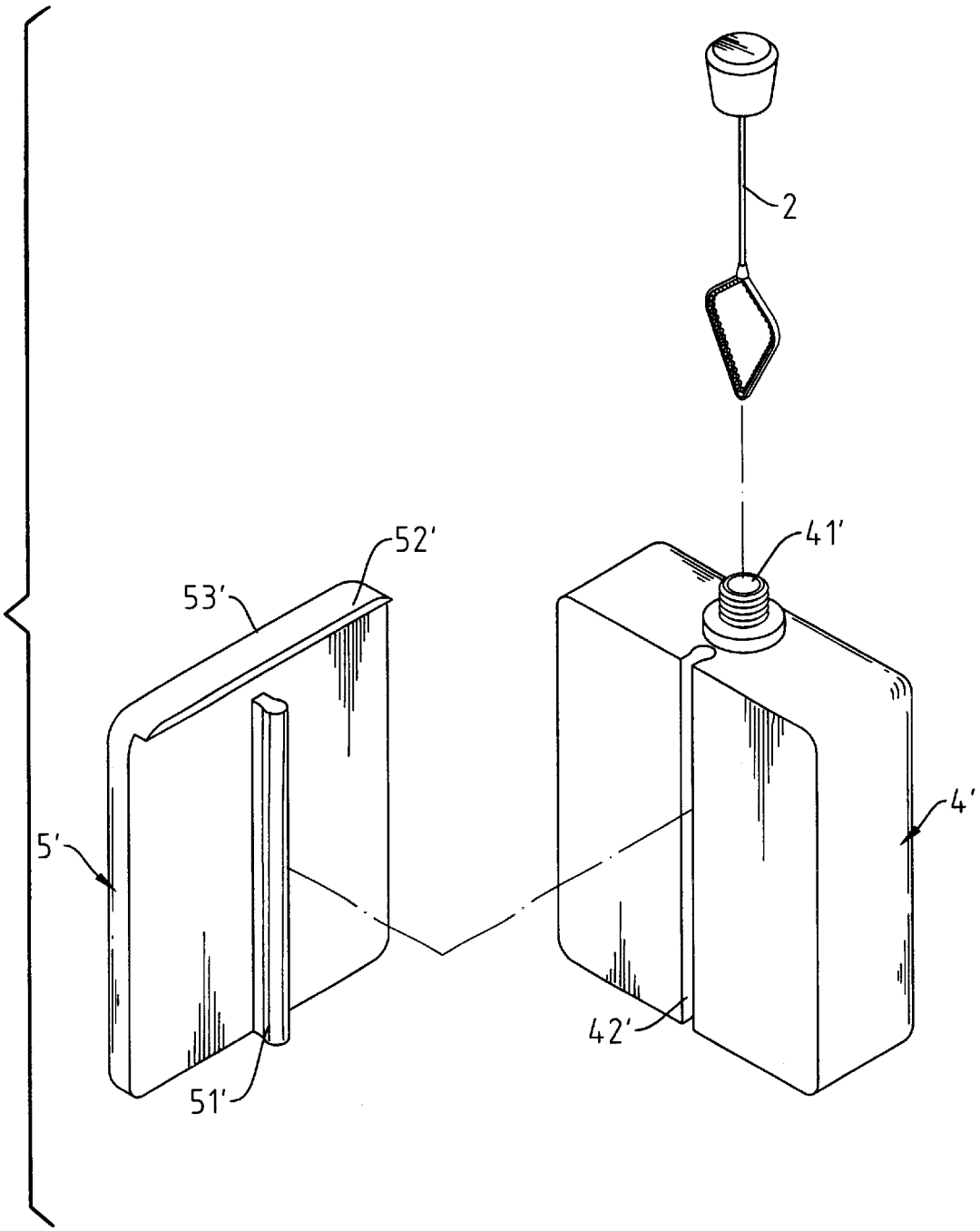
FIG. 7 is an exploded view of a bubble-blowing apparatus according to the third embodiment of the present invention.

FIG. 7 is an exploded view of a bubble-blowing apparatus according to the third embodiment of the present invention. According to this embodiment, the bubble-blowing apparatus is comprised of a fluid container 4', an applicator 2, and an attachment 5'. The fluid container 4' holds a bubble fluid for blowing bubbles, having a bobble neck 41' and a coupling grooves 42' longitudinally disposed in the front sidewall on the middle and extended to the top and bottom walls. The attachment 5' has a toy 53' incorporated in the front wall, a stop flange 52' transversely disposed at the top, and a coupling rail 51' longitudinally disposed in the back wall on the middle below the top flange 52' corresponding to the coupling groove 42' of the fluid container 4'.

Figure 8:
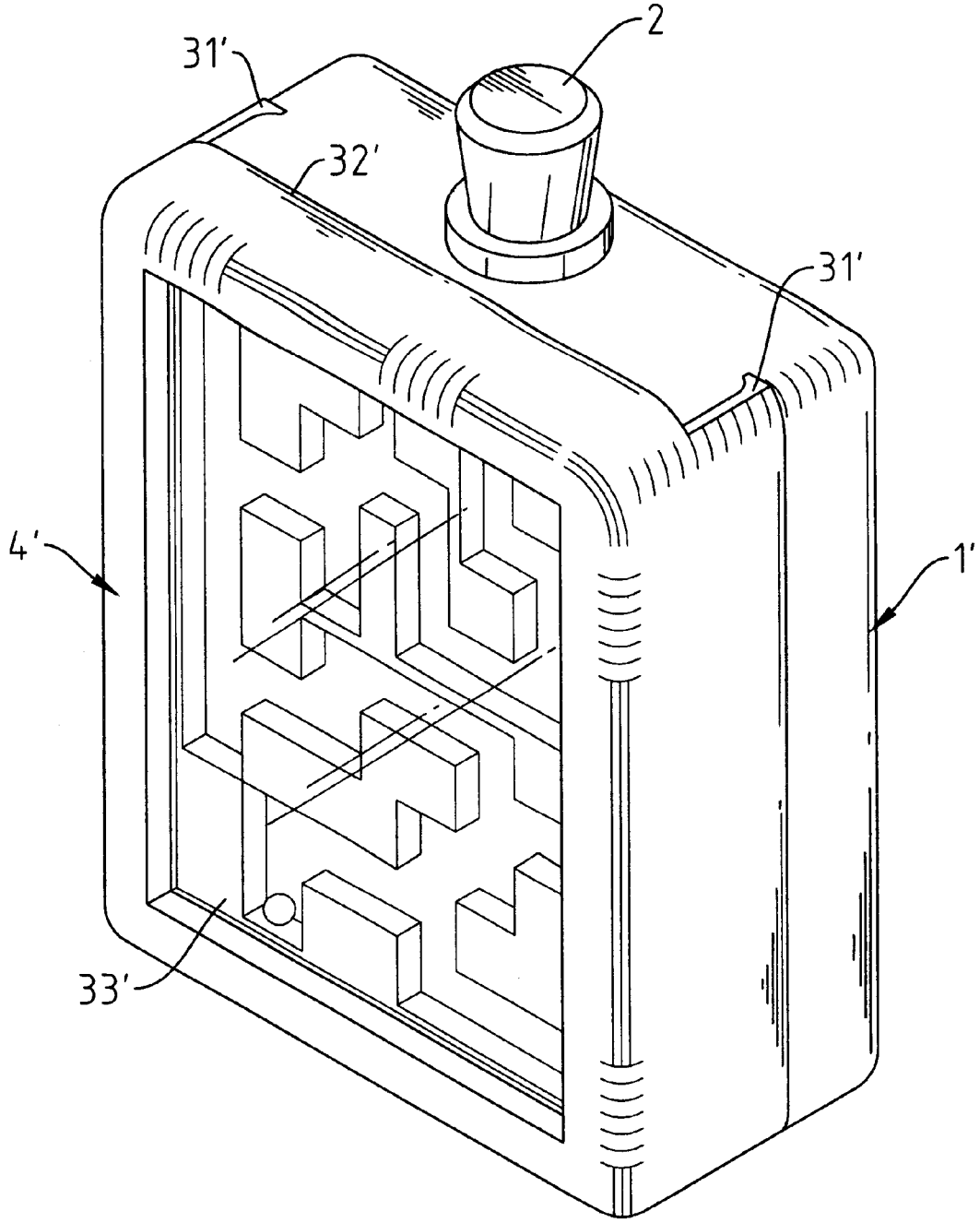
FIG. 8 is an elevational view of a bubble-blowing apparatus according to the fourth embodiment of the present invention.
Figure 9:
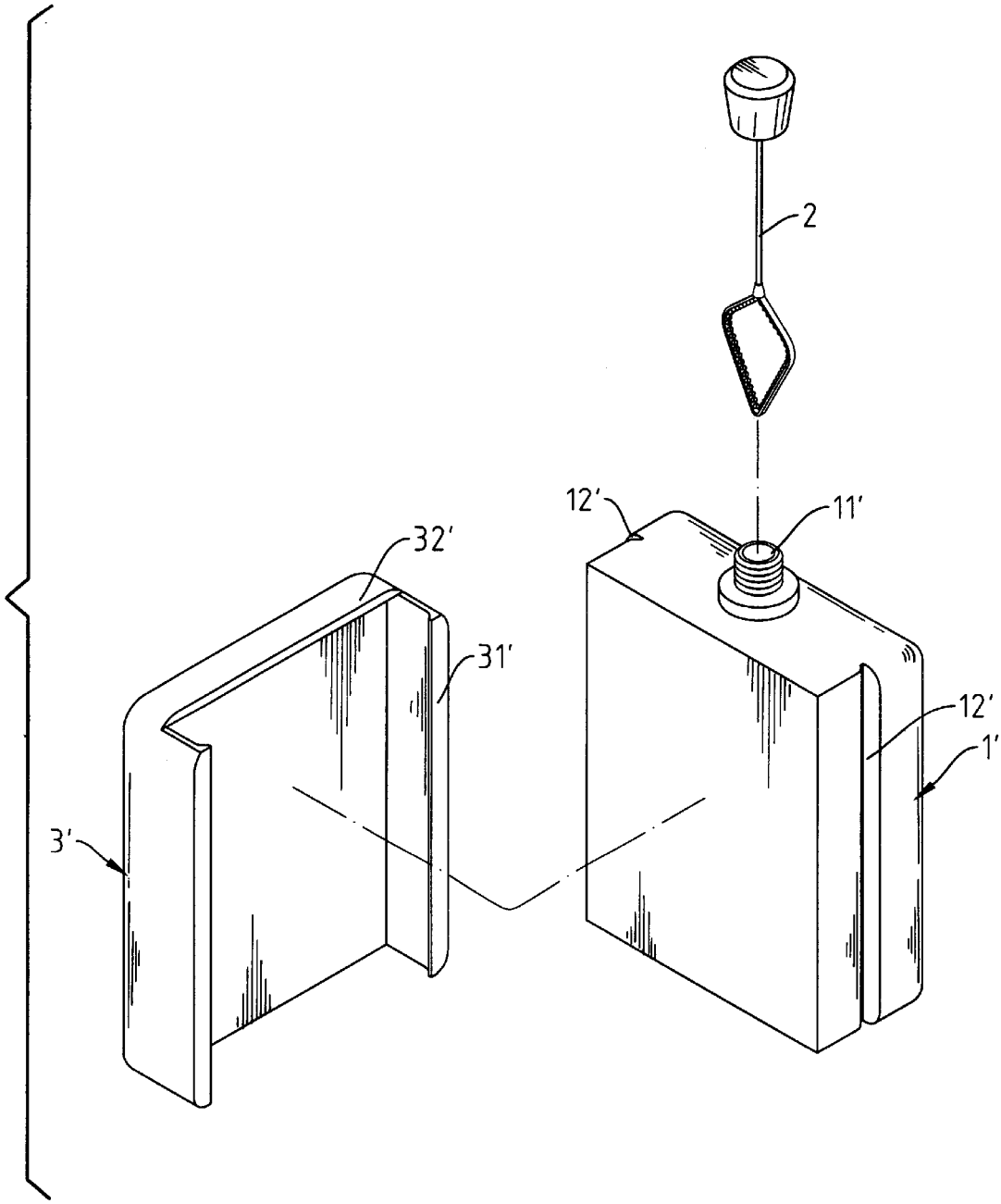
FIG. 9 is an exploded view of the bubble-blowing apparatus according to the fourth embodiment of the present invention.
Figure 10:
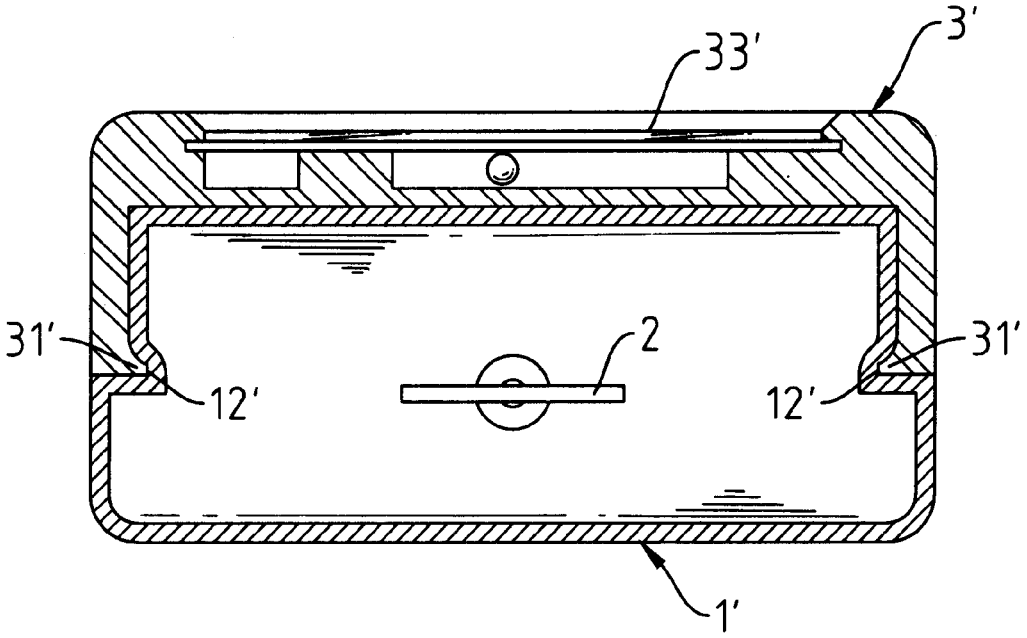
FIG. 10 is a cross-sectional view of the bubble-blowing apparatus according to the fourth embodiment of the present invention.

FIGS. 8~10 show a bubble-blowing apparatus according to the fourth embodiment of the present invention. According to this embodiment, the bubble-blowing apparatus is comprised of a fluid container 1', an applicator 2, and an attachment 3'. The fluid container 1' holds a bubble fluid for blowing bubbles, having a bobble neck 11' and two coupling grooves 12' longitudinally arranged in parallel in the two stepped lateral sidewalls and extended to the top and bottom walls. The attachment 3' has a toy 33' incorporated in the front wall, a stop flange 32' transversely disposed at the top, and two coupling rails 31' longitudinally arranged in parallel at the back wall below the top flange 31' corresponding to the coupling grooves 12' of the fluid container 1'.

Figure 11:
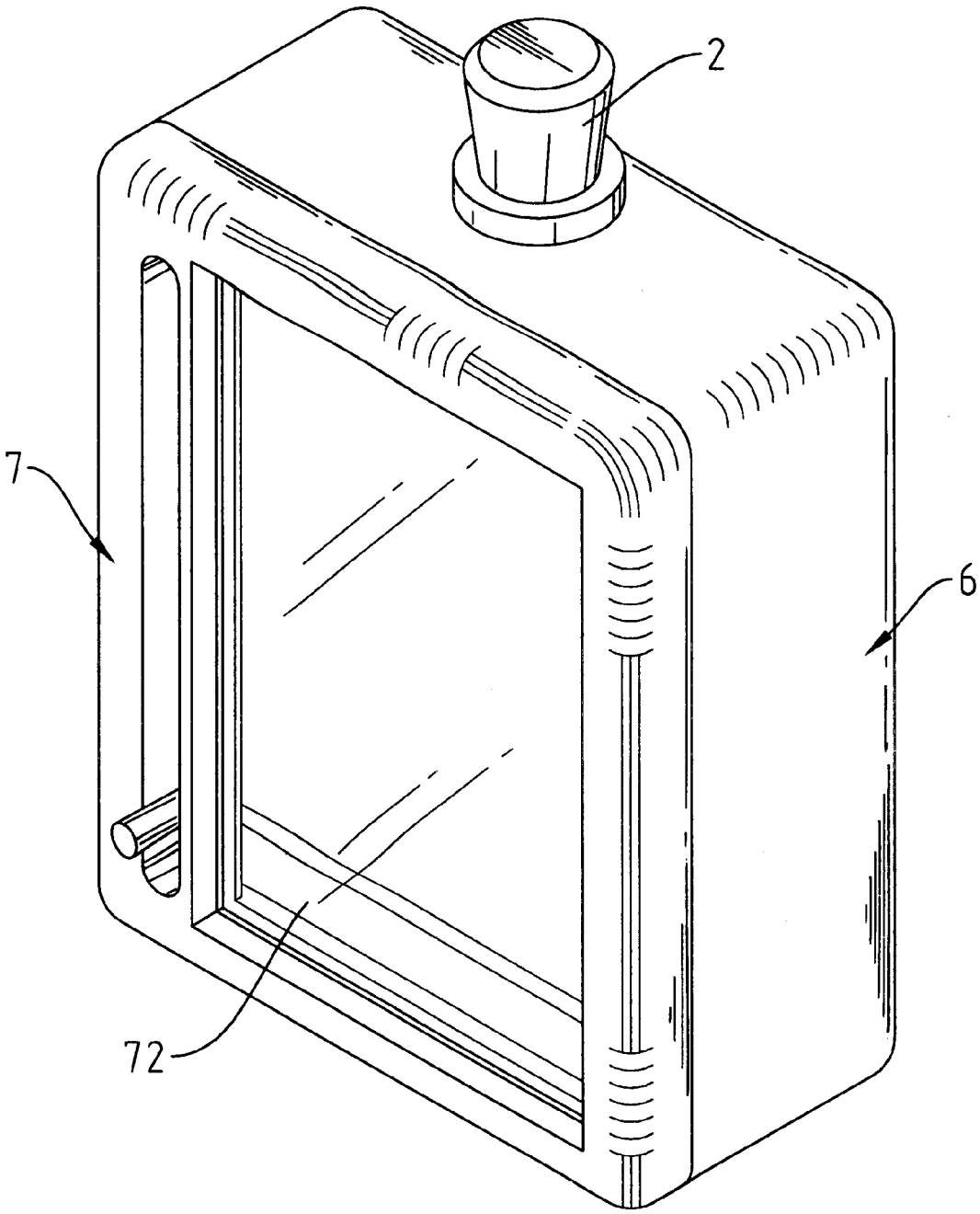
FIG. 11 is an elevational view of a bubble-blowing apparatus according to the fifth embodiment of the present invention.
Figure 12:
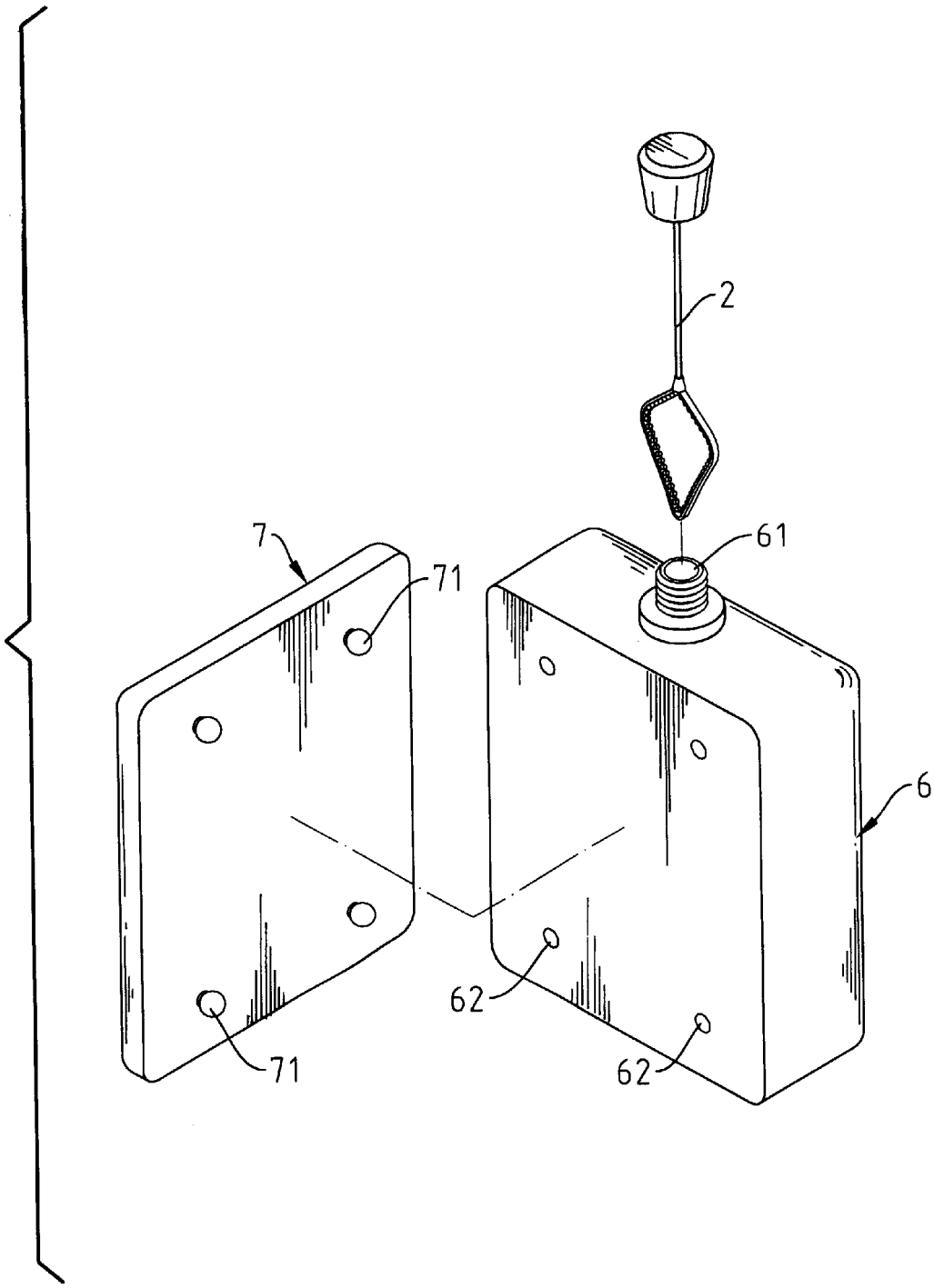
FIG. 12 is an exploded view of the bubble-blowing apparatus according to the fifth embodiment of the present invention.
Figure 13:
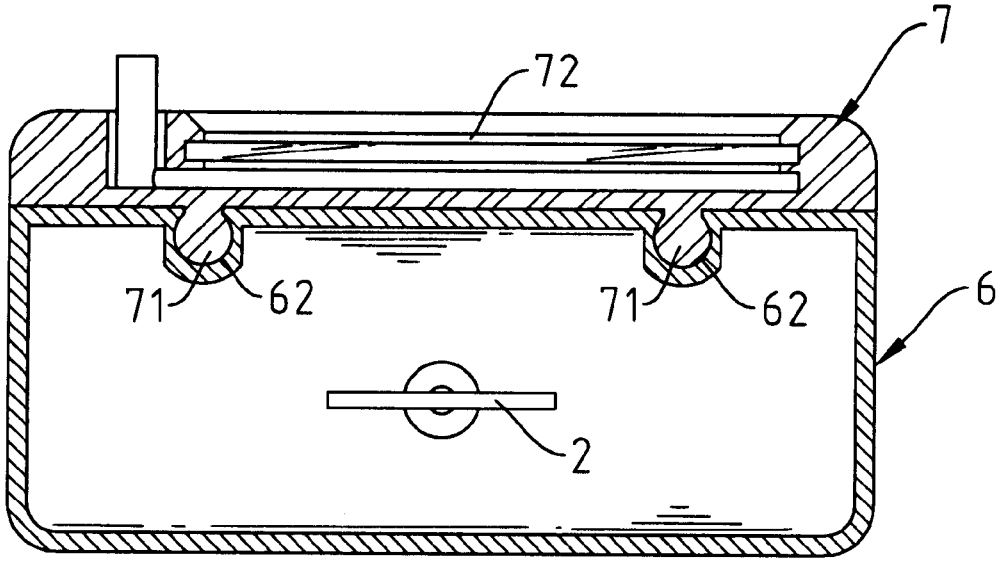
FIG. 13 is a cross-sectional view of the bubble-blowing apparatus according to the fifth embodiment of the present invention.

FIGS. 11~13 show a bubble-blowing apparatus according to the fifth embodiment of the present invention. According to this embodiment, the bubble-blowing apparatus is comprised of a fluid container 6, an applicator 2, and an attachment 7. The fluid container 6 holds a bubble fluid for blowing bubbles, having a bobble neck 41 and a plurality of recessed retaining holes 62 in the front wall. The attachment 7 has a toy 72 incorporated in the front wall, and a plurality of pegs 71 respectively protruded from the back wall and respectively detachably engaged into the recessed retaining holes 62 of the fluid container 6. According to this embodiment, the toy 72 is a drawing board.

Figure 14:
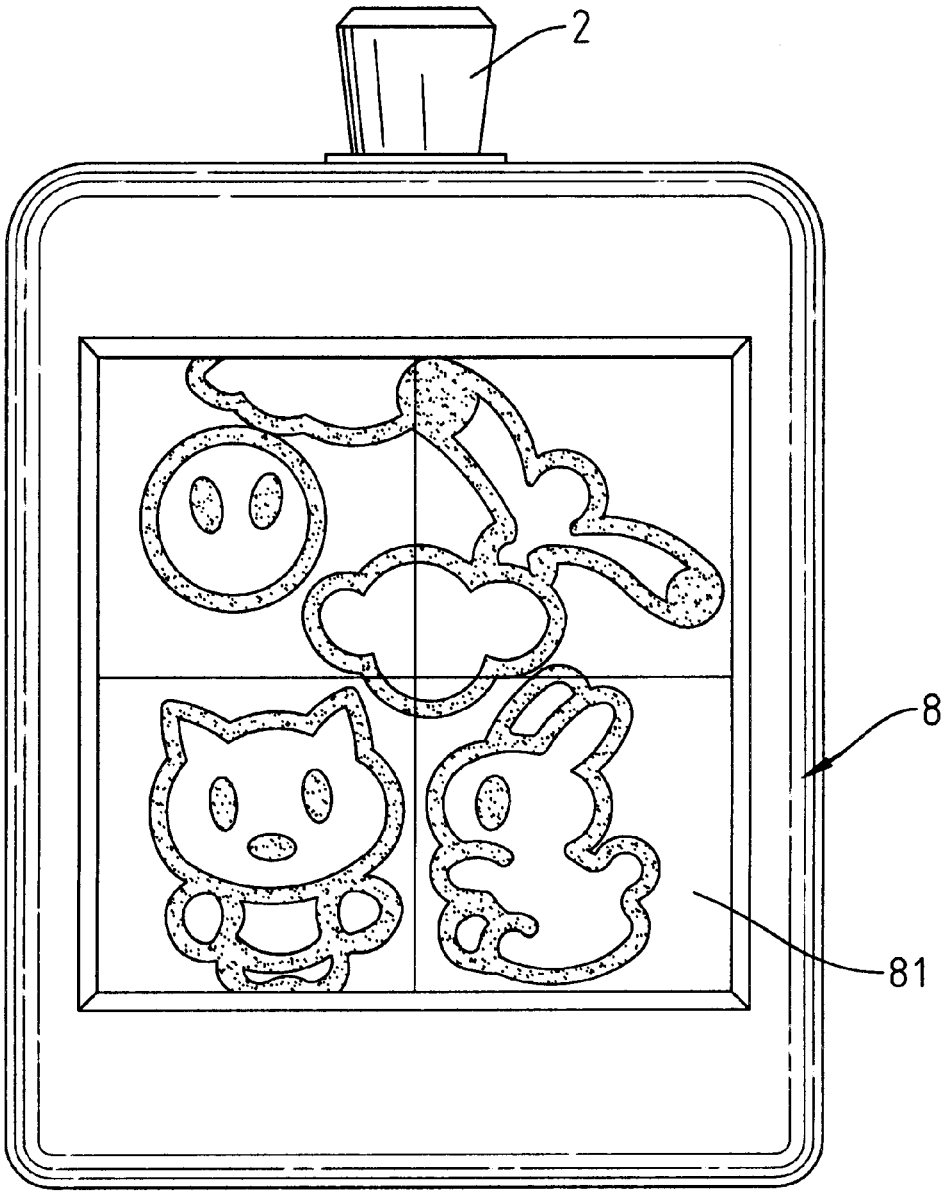
FIG. 14 is a plain view of a bubble-blowing apparatus according to the sixth embodiment of the present invention.

FIG. 14 shows a bubble-blowing apparatus constructed according to the sixth embodiment of the present invention. According to this embodiment, the toy 81 of the attachment 8 is a glued drawing covered with stripping pieces of paper. When the stripping pieces of paper removed, sands are spread over the glued drawing, and then excessive sands are removed from the glued drawing, enabling a layer of sands to be adhered to the glued drawing.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A bubble-blowing apparatus comprising a fluid container holding a bubble fluid, an applicator for picking up said bubble fluid from said fluid container for blowing bubbles, and an attachment detachably mounted on said fluid container, wherein said fluid container comprises at least one coupling groove; said attachment comprises a toy provided at a front side thereof and at least one coupling rail disposed at a back side thereof for coupling to the at least one coupling groove of said fluid container.

2. The bubble-blowing apparatus as claimed in claim 1, wherein said attachment further comprises a transversely extended top stop flange at the back side thereof for stopping said attachment on said fluid container after connection of said at least one coupling rail to said at least one coupling groove.

3. The bubble-blowing apparatus as claimed in claim 1, wherein said at least one coupling groove includes two coupling grooves longitudinally disposed at two opposite lateral sides of said fluid container.

4. The bubble-blowing apparatus as claimed in claim 1, wherein said at least one coupling groove includes two coupling grooves longitudinally disposed at a front side of said fluid container.

5. The bubble-blowing apparatus as claimed in claim 1, wherein said at least one coupling groove includes one coupling groove longitudinally disposed in a front side of said fluid container on the middle.

6. A bubble-blowing apparatus comprising a fluid container holding a bubble fluid, an applicator for picking up said bubble fluid from said fluid container for blowing bubbles, and an attachment detachably mounted on said fluid container, wherein said fluid container comprises a plurality of recessed retaining holes disposed in a front side thereof; said attachment comprises a toy provided at a front side thereof and a plurality of pegs protruded from a back side thereof for fastening to the recessed retaining holes of said fluid container.

* * * * *